US008328310B2

(12) United States Patent
Toda et al.

(10) Patent No.: US 8,328,310 B2
(45) Date of Patent: Dec. 11, 2012

(54) PRINTING APPARATUS AND PRINTING METHOD PROVIDING BAND SUPPRESSION BETWEEN NOZZLE BLOCKS

(75) Inventors: Masaru Toda, Inagi (JP); Tsuyoshi Shibata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 613 days.

(21) Appl. No.: 12/535,233

(22) Filed: Aug. 4, 2009

(65) Prior Publication Data

US 2010/0033526 A1 Feb. 11, 2010

(30) Foreign Application Priority Data

Aug. 8, 2008 (JP) ..... 2008-205908

(51) Int. Cl.
*B41J 29/38* (2006.01)

(52) U.S. Cl. ..... 347/12; 347/41

(58) Field of Classification Search ..... 347/12, 347/41

See application file for complete search history.

(56) References Cited

U.S. PATENT DOCUMENTS 6,206,502 B1 3/2001 Kato et al.
6,874,864 B1 4/2005 Maeda et al.
2008/0100654 A1* 5/2008 Kitahara et al. ..... 347/12
2008/0150979 A1* 6/2008 Shibata et al. ..... 347/9
2009/0161130 A1 6/2009 Mabuchi et al.

FOREIGN PATENT DOCUMENTS

JP 2000-108322 A 4/2000
JP 2002-96455 A 4/2002

* cited by examiner

*Primary Examiner* — Mark Robinson
*Assistant Examiner* — Andrew Jordan
(74) *Attorney, Agent, or Firm* — Fitzpatrick, Cella, Harper & Scinto

(57) ABSTRACT

A multipass printing is performed by setting the print permission ratios, predetermined for the nozzles in adjoining first and second blocks, in a way that satisfies the following conditions (i) and (ii). (i) The print permission ratio in the boundary section between the first and second blocks represents a value between the print permission ratio in the non-boundary section of the first block and that of the second block. (ii) The print permission ratios in the non-boundary sections of the first and second blocks are each set substantively constant. This arrangement allows the print permission ratio to be adjusted among nozzle blocks, thus satisfying the condition that the print permission ratio in a boundary between adjoining nozzles blocks does not change sharply and that the print permission ratio is substantively constant in each of the nozzle blocks. It is possible to suppress "interband variations", "seam lines" and "intraband variations" coincidentally.

20 Claims, 15 Drawing Sheets

COMPARISON OF IMAGE IMPAIRMENTS AMONG DIFFERENT MASK PATTERNS

○:NOT NOTICEABLE ×:NOTICEABLE

| PATTERN | INTERBAND VARIATIONS | INTRABAND VARIATIONS | SEAM LINES |
|---|---|---|---|
| FLAT MASK | × | ○ | × |
| GRADATION MASK | ○ | × | ○ |
| STEPWISE MASK | ○ | ○ | × |
| MASK OF THE INVENTION | ○ | ○ | ○ |

FIG.12

COMPARISON OF IMAGE IMPAIRMENTS AMONG DIFFERENT MASK PATTERNS

○:NOT NOTICEABLE ×:NOTICEABLE

| BOUNDARY SECTION DEPTH | INTRABAND VARIATIONS | SEAM LINES |
|---|---|---|
| 16 NOZZLES (EQUIVALENT TO 0.34 mm) | ○ | × |
| 64 NOZZLES (EQUIVALENT TO 1.35 mm) | ○ | ○ |
| 256 NOZZLES (EQUIVALENT TO 5.42 mm) | × | ○ |

FIG.13

PRINTING APPARATUS AND PRINTING METHOD PROVIDING BAND SUPPRESSION BETWEEN NOZZLE BLOCKS

BACKGROUND OF THE INVENTION

1. Field of the Invention

The present invention relates to a serial type printing apparatus that progressively forms an image on a print medium by repetitively alternating a printing scan, that causes a print head to execute printing as it scans over the print medium, and a print medium conveying operation.

2. Description of the Related Art

The serial type printing apparatus generally employs a multipass printing method in order to reduce seam lines appearing at boundaries between printing scans and a density (or grayscale) unevenness caused by ink ejection characteristic variations among individual nozzles. Such a multipass printing is known to be able to produce an image whose uniformity improves as the number of passes (the number of printing scans) required to print a unit area is increased. The increased number of passes, however, is also known to cause a fall in throughput. Therefore, there is a growing call for a printing method capable of producing a high quality image with as small a number of passes as possible.

Possible methods for improving throughput include adopting a bidirectional multipass printing. In the bidirectional multipass printing, a printing operation is performed in both forward and backward movements of a carriage on which a print head is mounted. When compared with a unidirectional multipass printing of the same pass number, the bidirectional multipass printing can reduce the number of its scans to about half that of the unidirectional printing, thus significantly reducing the time taken by the printing operation. It should be noted, however, that the bidirectional multipass printing has been known to have a problem of band-to-band variations in which density, color or glossiness of a printed image varies in a pitch that matches the print medium conveying distance. In this patent document, such variations among bands caused by the bidirectional multipass printing is referred to as "interband variations".

FIGS. 1A and 1B explain in detail a cause and a phenomenon of the interband variations. FIG. 1A shows how a 4-pass bidirectional printing is done using a print head 1000 that has four nozzle arrays for ejecting cyan ink (C), magenta ink (M), yellow ink (Y) and black ink (K) respectively. The print head 1000 alternately performs a forward direction printing scan and a backward direction printing scan in an X direction (main scan direction) and, after each printing scan, moves in a Y direction (subscan direction) relative to the print medium by a distance equal to the width of a unit area.

Here let us focus our attention on the left end part of a first band having a width of a unit area. The area of interest is applied inks in the order of C→M→Y→K in the first printing scan and, after a relatively long period of time corresponding to almost one complete forward and backward scan of the print head, is applied inks in the order of K→Y→M→C. A left end part of a second band adjacent to the first band is applied inks in the order of K→Y→M→C and, after a relatively short period of time corresponding to almost only a reverse operation of the print head, is applied inks in the order of C→M→Y→K. In subsequent printing scans, odd-numbered bands including and following a third band that adjoins the second band are applied inks in the same manner as the first band; and even-numbered bands including and following a fourth band that adjoins the third band are applied inks in the same way as the second band. That is, two bands, that differ in the order of color ink application to the print medium and in the interval between ink application timings, are alternately arranged in the Y direction. The color ink application order and the ink application interval have some effects on density level, color hue or glossiness of an image formed on the print medium. As a result, in an image with its unit area bands, that differ in the ink application order and ink application timing, alternately arranged as shown in FIG. 1B, "interband variations" are observed.

To reduce a variety of image impairments including such "interband variations" observed in a multipass printing, it is effective to appropriately adjust a print permission ratio of individual nozzles arrayed in the print head. For example, Japanese Patent Laid-Open Nos. 2000-108322 and 2002-96455 describe a method that uses a mask pattern designed to give a predetermined deviation or bias to the print permission ratio of individual nozzles, thereby making "seam lines" and density unevenness less noticeable even if a small number of passes are used.

In maintaining the uniformity of an image it is effective, not only in the above patent documents but also in other forms of multipass printing, to have a means for controlling the print permission ratio in each printing scan of the multipass printing. This is because the degree to which the "interband variations" show up depends on various conditions such as the kind of print medium and the kind of inks used and, if the print permission ratio can be adjusted in each printing scan according to these conditions, the uniformity of the image can be maintained.

However, when the above print permission ratio is adjusted to suppress the "interband variations", another image impairment problem may arise, such as "seam lines" between different bands and variations within each band. If, for example, the print permission ratio is differentiated among different printing scans over unit areas on a print medium, a plurality of nozzles arrayed in the print head are required to be divided into blocks of a width equal to the width of the unit area and the individual nozzle blocks be set to have different print permission ratios from one another. In that case, however, if there is a large difference in print permission ratio between adjoining nozzle blocks, a seam line may show up in narrow areas on a print medium printed by a boundary part of these nozzle blocks.

To deal with this problem, as disclosed in Japanese Patent Laid-Open No. 2002-96455, the seam lines can be made unnoticeable by progressively changing the print permission ratios of individual nozzles in each block so that a change in print permission ratio at a boundary between the adjoining nozzle blocks is not extremely large. However, where the print permission ratios of individual nozzles in each nozzle block are not made substantively constant or equal, variations or inconsistencies such as density variation, color unevenness or gloss unevenness may occur. In this patent document, a variation within a unit area that is produced by not making substantively constant the print permission ratios of individual nozzles in one nozzle block will be referred to as an "intraband variation".

That is, the conventional bidirectional multipass printing has not been able to solve the problems of "interband variations", "seam lines" and "intraband variations" at one time.

SUMMARY OF THE INVENTION

The present invention has been accomplished to solve the above-mentioned problems. It is therefore an object of this invention to provide a printing method capable of eliminating "interband variations", "seam lines" and "intraband variations" at one time and an ink jet printing apparatus capable of executing the printing method.

The first aspect of the present invention is A printing apparatus for executing a printing on a print medium by using a print head in which a plurality of nozzles are arrayed in a predetermined direction, comprising: a moving unit configured to move the print head in a movement direction different from the predetermined direction; a conveying unit configured to convey the print medium a distance in a conveying direction crossing the movement direction between the movements of the print head, the distance corresponding to a width of one of a plurality of nozzle blocks into which the plurality of nozzles are divided; and a control unit configured to cause the print head to execute the printing as the print head is moved, according to print permission ratios predetermined for individual nozzles in the plurality of nozzle blocks, the print permission ratio being a ratio of the number of those pixels that are permitted to be printed by each nozzle in one movement of the print head to a total number of pixels making up an area over which the nozzle passes in one movement of the print head; wherein (i) the plurality of nozzle blocks include a first nozzle block and a second nozzle block adjoining the first nozzle block; (ii) the print permission ratios of non-boundary sections in the first nozzle block and the second nozzle block, excluding a boundary section of the first nozzle block and the second nozzle block, differ from each other and are substantively constant; and (iii) the print permission ratio of the boundary section is set to change stepwise or continuously between the print permission ratios respectively corresponding to the non-boundary sections in the first and second nozzle blocks.

The second aspect of the present invention is a printing apparatus for executing a printing on a print medium by using a print head in which a plurality of nozzles are arrayed in a predetermined direction, comprising: a moving unit configured to move the print head in a movement direction different from the predetermined direction; a conveying unit configured to convey the print medium a distance in a conveying direction crossing the movement direction between the movements of the print head, the distance corresponding to a width of one of a plurality of nozzle blocks into which the plurality of nozzles are divided; and a control unit configured to cause the print head to execute the printing as the print head is moved, according to print permission ratios predetermined for individual nozzles in the plurality of nozzle blocks, the print permission ratio being a ratio of the number of those pixels that is permitted to print by each nozzle in one movement of the print head to a total number of pixels making up an area over which the nozzle passes in one movement of the print head; wherein (i) each of the plurality of nozzle blocks has boundary nozzles making up a boundary section of adjoining nozzle blocks and non-boundary nozzles making up a non-boundary section excluding the boundary section; (ii) the plurality of nozzle blocks include a first nozzle block with the print permission ratio of its non-boundary nozzles set substantively to a first value and a second nozzle block with the print permission ratio of its non-boundary nozzles set substantively to a second value; and (iii) the print permission ratio of the boundary nozzles in the first and the second nozzle blocks changes stepwise or continuously between the first value and the second value.

The third aspect of the present invention is a printing apparatus for executing a printing on a print medium by using a print head in which a plurality of nozzles are arrayed in a predetermined direction, comprising: a moving unit configured to move the print head in a movement direction crossing the predetermined direction; a conveying unit configured to convey the print medium a distance in a conveying direction crossing the movement direction between the movements of the print head, the distance corresponding to a width of one of a plurality of nozzle blocks into which the plurality of nozzles are divided; and a mask pattern determining a ratio of the number of those pixels that each nozzle in the plurality of nozzle blocks is permitted to print in one movement of the print head to a total number of pixels making up an area over which the nozzles pass in one movement of the print head, the mask pattern being designed to meet all of below requirements (i), (ii) and (iii); and a control unit configured to cause the print head to execute the printing as the print head is moved, according to the mask pattern and image data; wherein (i) a ratio of pixels permitted to be printed by nozzles in a boundary section of a first nozzle block and a second nozzle block adjoining the first nozzle block is higher than a ratio of pixels permitted to be printed by nozzles in a non-boundary section in the first nozzle block and lower than a ratio of pixels permitted to be printed by nozzles in a non-boundary section in the second nozzle block, the first and second nozzle block being included in the plurality of nozzle blocks; (ii) the ratio of pixels permitted to be printed by the nozzles in the non-boundary section in the first nozzle block is substantively constant in the predetermined direction; and (iii) the ratio of pixels permitted to be printed by the nozzles in the non-boundary section in the second nozzle block is substantively constant in the predetermined direction.

The fourth aspect of the present invention is a printing method for executing a printing on a print medium by using a print head in which a plurality of nozzles are arrayed in a predetermined direction, comprising: moving the print head in a movement direction different from the predetermined direction; conveying the print medium a distance in a conveying direction crossing the movement direction between the movements of the print head, the distance corresponding to a width of one of a plurality of nozzle blocks into which the plurality of nozzles are divided; and executing the printing as the print head is moved, according to print permission ratios predetermined for individual nozzles in the plurality of nozzle blocks, the print permission ratio being a ratio of the number of those pixels that are permitted to be printed by each nozzle in one movement of the print head to a total number of pixels making up an area over which the nozzle passes in one movement of the print head; wherein (i) each of the plurality of nozzle blocks has boundary nozzles making up a boundary section between it and an adjoining nozzle block and non-boundary nozzles making up a non-boundary section excluding the boundary section; (ii) the plurality of nozzle blocks include a first nozzle block having its non-boundary nozzles set substantively to a first value of the print permission ratio and a second nozzle block having its non-boundary nozzles set substantively to a second value of the print permission ratio; and (iii) the print permission ratio of boundary nozzles in the first and the second nozzle blocks changes stepwise or continuously between the first value and the second value.

Further features of the present invention will become apparent from the following description of exemplary embodiments (with reference to the attached drawings).

BRIEF DESCRIPTION OF THE DRAWINGS

FIG. 12 shows a result of comparison in terms of image quality when 4-pass printings are performed using the mask patterns of FIGS. 8-11 in the ink jet printing system of FIGS. 2-5;

FIG. 13 shows a result of examination into the states of "intraband variations" and "seam lines" when a 4-pass printing is performed on matte paper using a mask pattern of embodiment 1 by changing the width of boundary sections to three different settings;

DESCRIPTION OF THE EMBODIMENTS

Now, embodiments of the present invention will be described detail.

Figure 2:
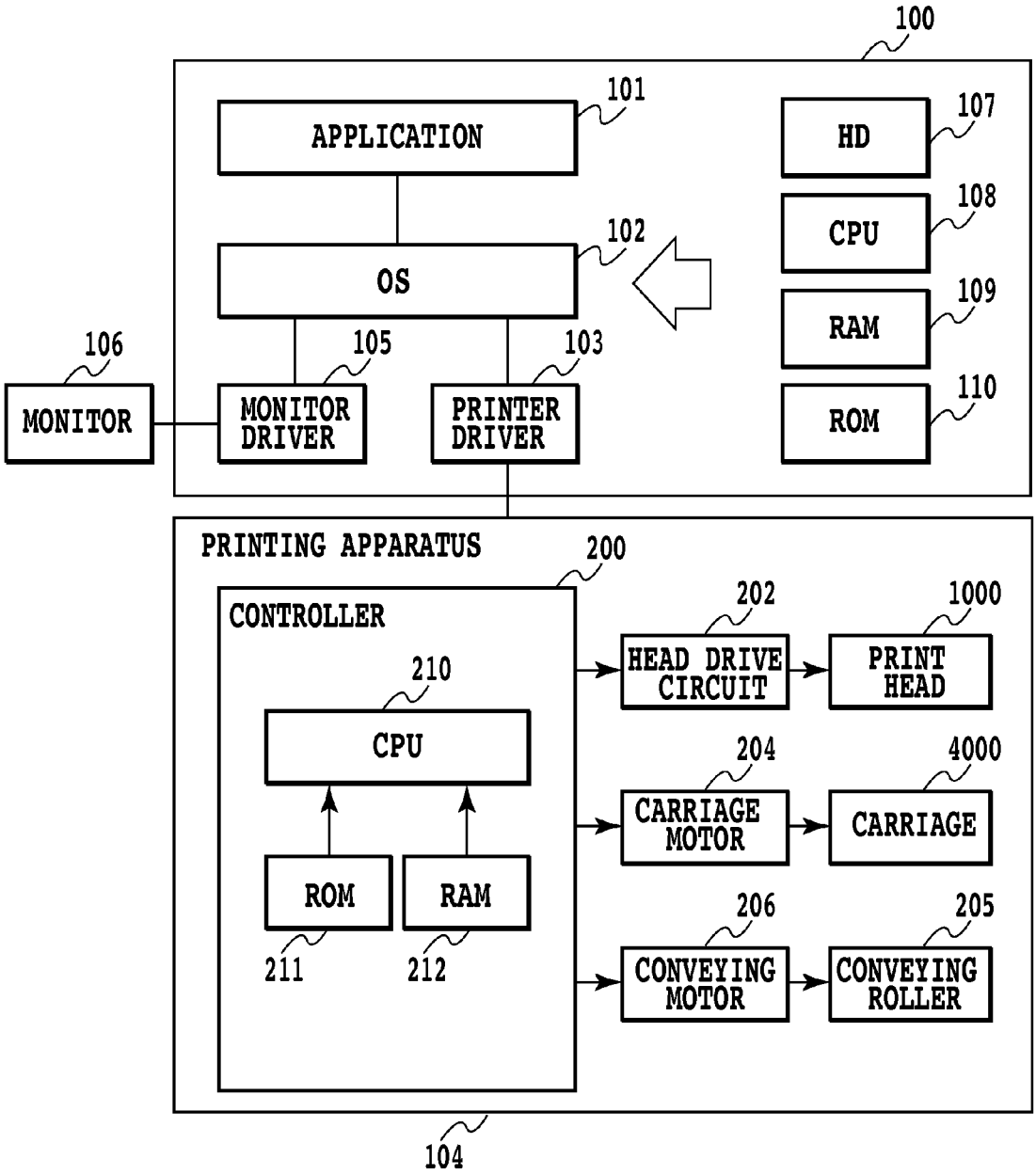
FIG. 2 is a block diagram showing a configuration of a host device 100 and a printing apparatus 104 in a printing system applicable to the present invention.

FIG. 2 is a block diagram showing a configuration of a host device 100 and a printing apparatus 104 making up a printing system applicable to this invention.

A CPU 108, according to a variety of programs stored in a hard disk (HD) 107 and a ROM 110, activates software such as application 101, printer driver 103 and monitor driver 105 through an operating system 102. At this time, a RAM 109 is used as a work area in executing various processing. The monitor driver 105 is software to generate image data to be displayed on a monitor 106. The printer driver 103 is software to convert the image data transferred from the application 101 to the OS 102 into multivalued or binary image data that can be received by the printing apparatus 104 and then send the converted image data to the printing apparatus 104.

The printing apparatus 104 has a controller 200, a print head 1000, a head drive circuit 202, a carriage 4000, a carriage motor 204, a conveying roller 205 and a conveying motor 206. The head drive circuit 202 drives the print head 1000 to eject ink. The carriage motor 204 reciprocally moves the carriage 4000 mounting the print head 1000. The conveying motor 206 drives a conveying roller 205 to move a print medium. The controller 200 that controls the apparatus as a whole includes a CPU 210 in the form of microprocessor, a RON 211 storing a control program and a RAM 212 that the CPU uses when it processes the image data. The ROM 211 stores mask patterns shown in FIG. 11 and FIG. 15 described below and a control program to control multipass printing. The controller 200 during a multipass printing, for example, controls the head drive circuit 202, carriage motor 204 and conveying motor 206 and also generates image data for individual scans of the multipass printing. In more detail, the controller 200 according to the control program, reads a mask pattern from the ROM 211 and, by using the mask pattern thus read out, divides the image data for each unit area into image data corresponding to individual scans of the multipass printing. Further, the controller 200 controls the head drive circuit 202 to cause the print head 1000 to eject ink according to the divided image data.

Figure 3:
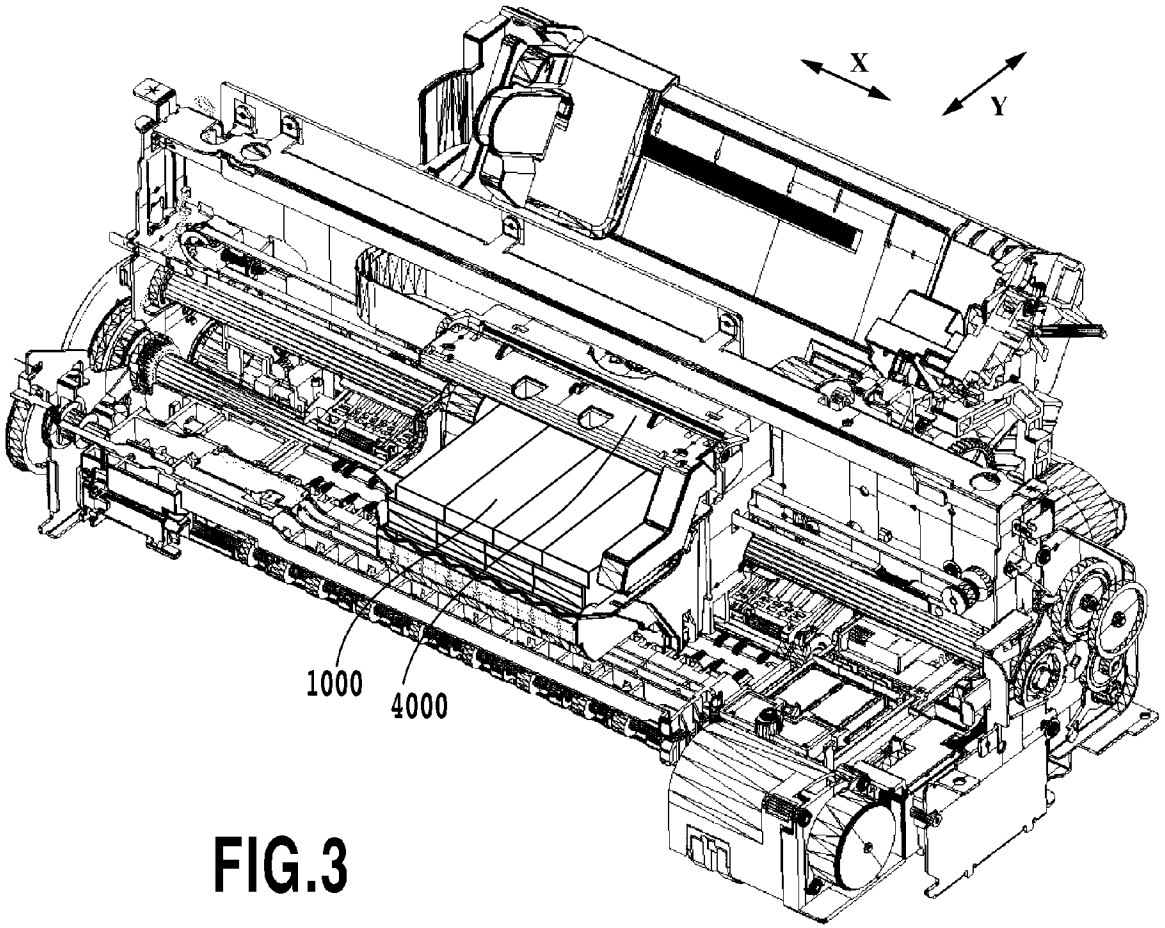
FIG. 3 is a perspective view showing an outline construction of the printing apparatus 104 employed in an embodiment of this invention.

FIG. 3 is a perspective view showing an outline construction of the printing apparatus 104 adopted in this embodiment. The carriage 4000 carries the print head 1000 having four nozzle arrays that eject cyan (C), magenta (M), yellow (Y) and black (K) ink respectively. The carriage 4000 can travel in a direction of arrow X (second direction). A control means not shown, made up of a controller, causes the print head 1000 to eject ink according to the image data received from the host device as the carriage 4000 travels in the X direction. When one printing scan by the print head 1000 is complete, a conveying means not shown, composed of the conveying roller or the like, conveys the print medium a distance corresponding to the number of passes of the multipass printing in a Y direction crossing the X direction. After this, the printing by the print head moving in the X direction and the conveying of the print medium in the Y direction are repetitively alternated to progressively form an image on the print medium.

Figure 4:
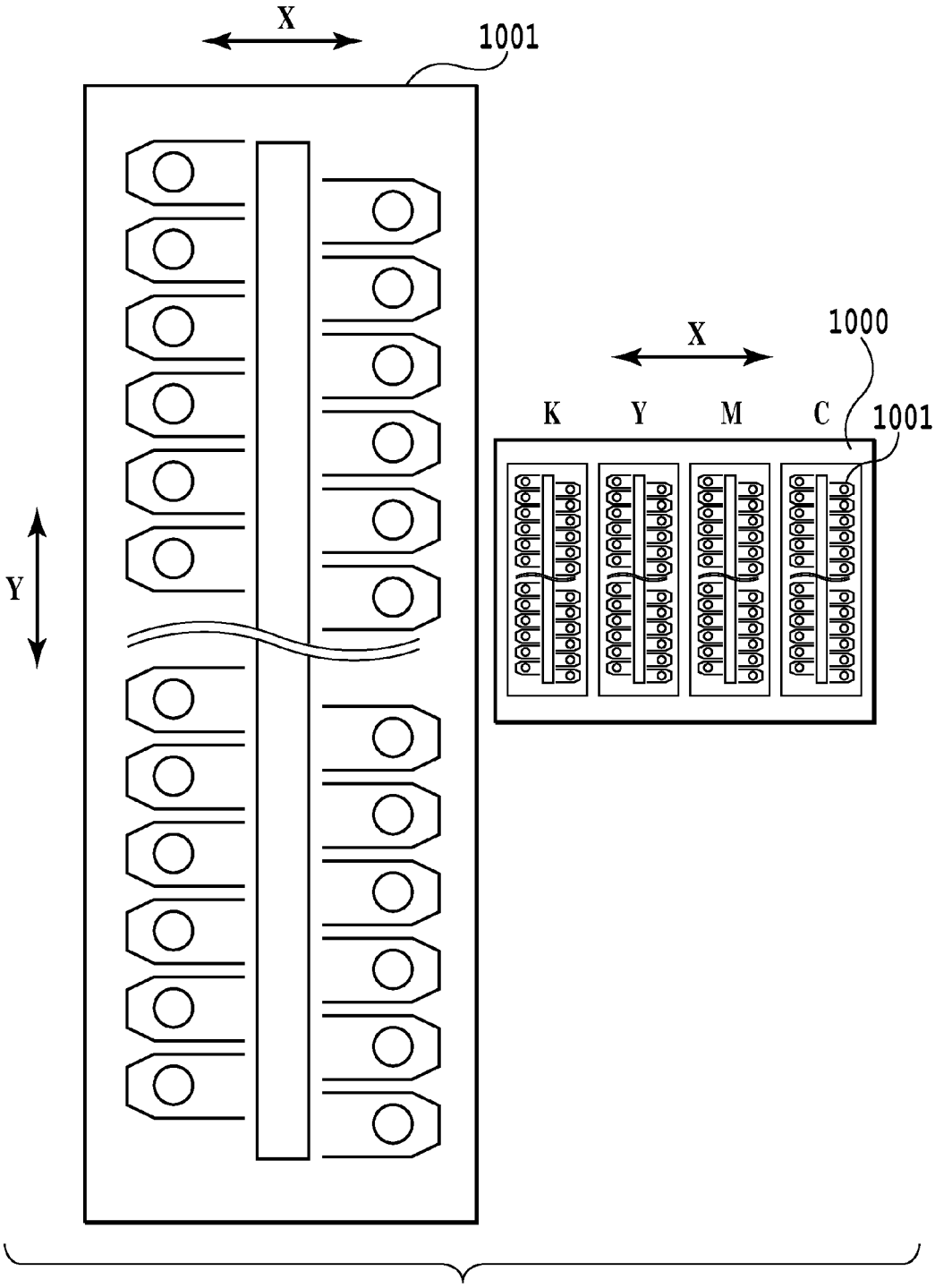
FIG. 4 is a schematic diagram showing how nozzles are arrayed in the print head used in the embodiment of this invention.

FIG. 4 is a schematic diagram showing nozzles arrayed in the print head 1000 of this embodiment. The print head 1000 has four nozzle groups 1001 arranged side by side in the X direction (in which the head is allowed to move) that eject four inks—1st to 4th ink—respectively. In this embodiment, the first ink is a cyan (C) ink, the second ink a magenta (M) ink, the third ink a yellow (Y) ink and the fourth ink a black (K) ink. Each of these color ink nozzle groups 1001 has 1,280 nozzles arrayed in the first direction. In more detail, each of the nozzle groups 1001 has two nozzle arrays, with 640 nozzles each that are arranged at 600-dpi intervals in the first direction (in this example, Y direction), in such a way that the two nozzle arrays are staggered one-half pitch from each other in the first direction. That is, by having the print head 1000 eject ink from individual nozzles as it moves in the X direction, an image can be printed that has a resolution of 1,200 dpi (dots/inch) in the Y direction. Although this embodiment uses a print head that has as many nozzle groups as ink colors, each with a plurality of nozzles ejecting the same color ink, the present invention, as described later, is not limited to this configuration.

For simplicity, explanation has been made in this embodiment assuming that the direction in which a plurality of nozzles ejecting the same color ink are arrayed (the first direction) coincides with the direction in which the print medium is conveyed (Y direction). It is noted, however, that the nozzle array direction (first direction) and the conveying direction (Y direction) may not necessarily need to match. If the nozzle array direction (first direction) is at some angle to the Y direction, the intended effects of this invention that are described in the following can also be produced.

Figure 5:
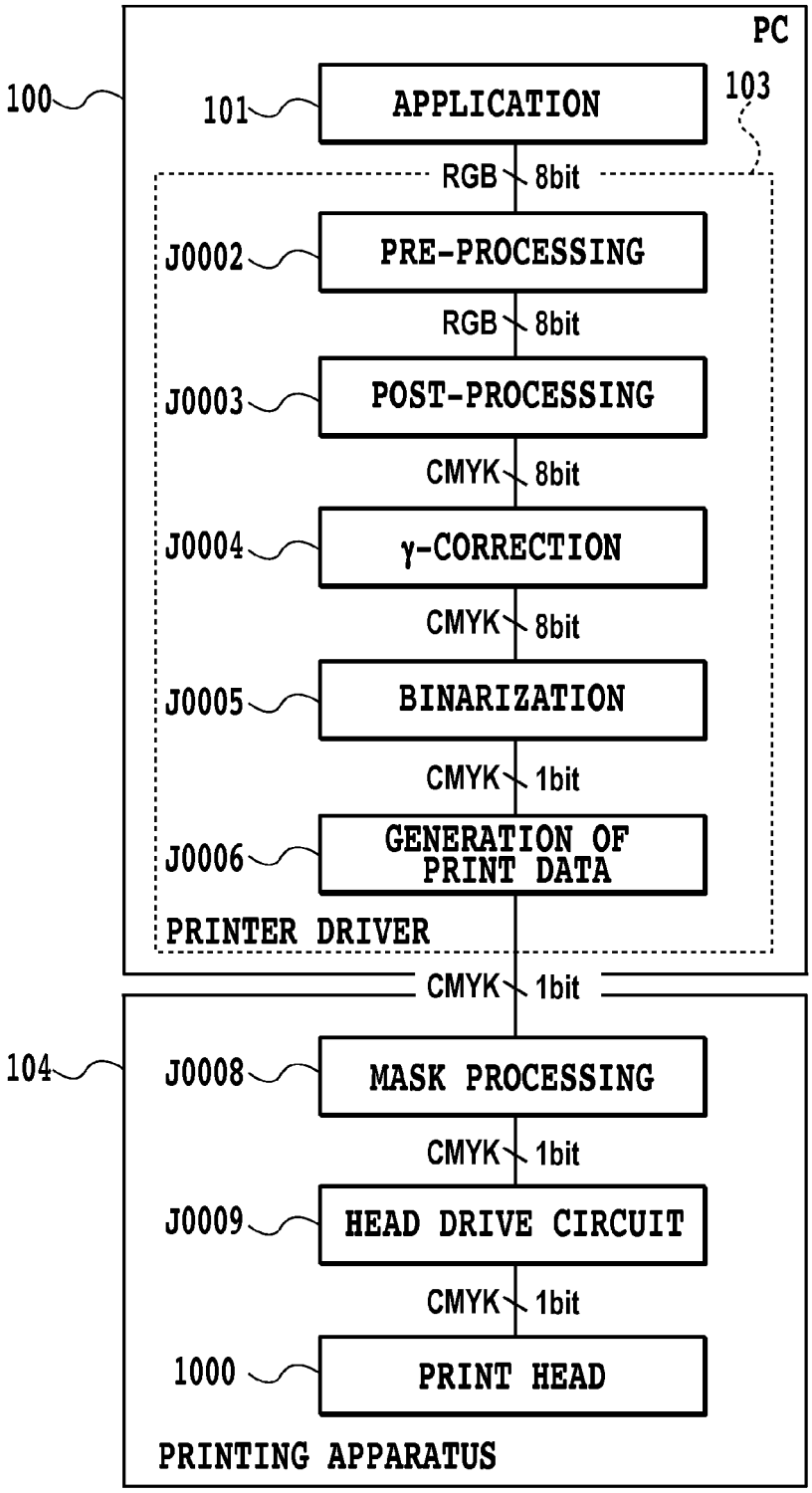
FIG. 5 is a block diagram showing a flow of image processing that the host device and the printing apparatus execute in the printing system used in the embodiment of this invention.

FIG. 5 is a block diagram showing a flow of image processing that the host device 100 and the printing apparatus 104 execute in the printing system described above.

In the host device 100 the user can create image data to be printed in the printing apparatus 104 by using the application 101. The image data created by the application 101 is transferred to the printer driver 103.

The printer driver 103 executes pre-processing J0002, post-processing J0003, a γ-correction J0004, a binarization operation J0005 and a print data generation operation J0006.

Referring to FIG. 2, in the pre-processing J0002, the application 101 performs a color space conversion operation to convert a color space of an image, that the application 101 displays on the monitor 106 through the monitor driver 105, into a color space of the printing apparatus 104. More specifically, the 8-bit image data R, G, B is converted into 8-bit data R, G, B within the color space of the printing apparatus 104 by referring to a three-dimensional LUT stored in the ROM 110.

Next, in the post-processing J0003, a signal value conversion operation is performed so that the converted 8-bit data R, G, B are converted into data represented by four ink colors C, M, Y, K of the print head 1000 mounted in the printing apparatus 104. More specifically, the 8-bit RGB data obtained in the pre-processing J0002 is converted into 8-bit CMYK data by referring to a three-dimensional LUT stored in the ROM 110.

In the next γ-correction J0004, the CMYK data obtained in the post-processing J0003 is subjected to the γ-correction. More specifically, a linear conversion is performed which linearly matches the 8-bit CMYK data, that was obtained by color separation, with a gradation characteristic of the printing apparatus.

In the binarization operation J0005, the γ-corrected, 8-bit CMYK data is subjected to a predetermined quantization operation for conversion into 1-bit CMYK data. The binarized image data is 1-bit information that determines whether or not to print a dot in a pixel of interest, the pixels being arranged at intervals matching a print resolution of the printing apparatus 104.

The print data generation operation J0006 adds to the four-color 1-bit data generated by the binarization operation J0005 control information associated with the printing operation, such as print medium information, print quality information and paper supplying method, in order to generate print data. The print data thus generated is supplied from the host device 100 to the printing apparatus 104.

The printing apparatus 104 performs mask processing J0008 using an already prepared mask pattern on the binary image data included in the received print data. Here, the mask pattern is a pattern of binary data that determines whether it is permitted or not permitted to print a dot in each of a plurality of pixels making up an area over which the nozzles pass in one scan movement of the print head. By this mask pattern a ratio or percentage of pixels that can be printed by the nozzles in one scan movement of the print head (print permission ratio) is determined. Therefore, printing according to a mask pattern means printing according to the print permission ratios predetermined for individual nozzles.

The mask processing J0008 divides, by using a predetermined mask pattern stored in the memory of the printing apparatus 104, the binary image data into pieces of image data each of that is printed by each of a plurality of nozzle blocks corresponding to scans of the multipass printing. More specifically, the mask pattern, that determines whether or not to print a dot in each of pixels within an area over which a nozzle pass in one printing scan of the print head, is ANDed with the binary image data for the nozzle entered from the host device 100. The resultant binary image data represents pixels that the print head needs to print in one printing scan. Then, the generated binary image data is sent to a head drive circuit J0009. Individual nozzles in the print head 1000 are activated to execute the printing operation at predetermined timings according to the binary image data.

In the image processing up to the printing operation described above, this embodiment gives features to the mask patterns used in the mask processing J0008 and adjusts the print permission ratios of individual nozzles. It is therefore possible to perform the multipass printing according to the image data and the print permission ratio that is predetermined for each nozzle irrelevant to the image data. Here "print permission ratio of a single nozzle" means a ratio of the number of those pixels that are permitted to be printed by the single nozzle in one scan movement of the print head to a total number of pixels making up an area over which the single nozzle passes in one scan movement of the print head.

Figure 6:
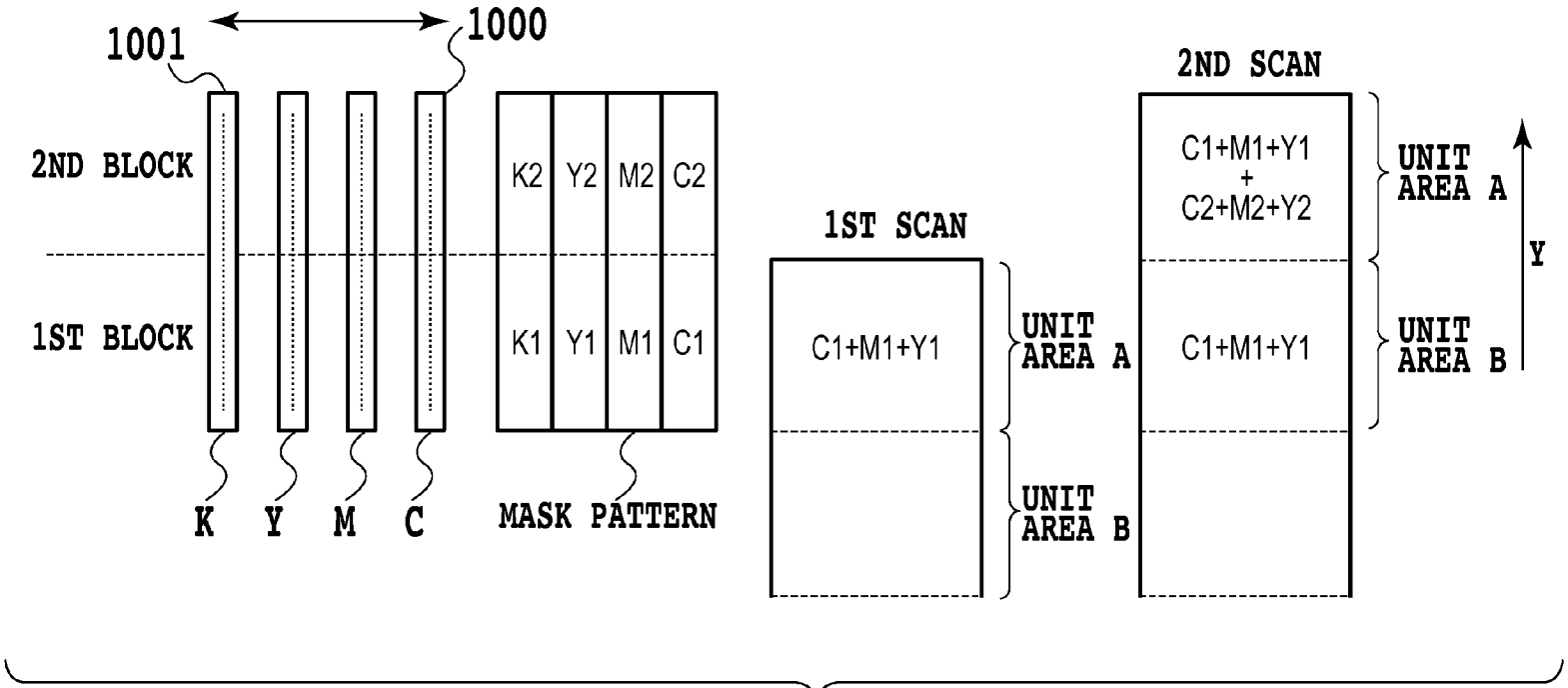
FIG. 6 is a schematic diagram briefly explaining how a multipass printing is performed.

FIG. 6 is a schematic diagram showing an outline of how the multipass printing is performed. The printing apparatus of this embodiment is a serial type ink jet printing apparatus which progressively forms an image by repetitively alternating a printing scan and a print medium conveying operation. In the printing scan the print head 1000 ejects ink according to binary image data as it travels in the X direction. In the print medium conveying operation, the print medium is conveyed in the Y direction. Here, a two-pass printing will be explained as an example.

In a 2-pass printing, each of the nozzle groups for different colors in the print head 1000 are divided into two nozzle blocks arranged in the direction of arrayed nozzles (in this example, Y direction)—a first nozzle block and a second nozzle block of 640 nozzles each. In each of the printing scans, the nozzle blocks print the binary image data according to mask patterns assigned to the individual nozzle blocks. Referring to FIG. 6, the printing process will be described by taking a cyan ink for example. In the following description, the "nozzle block" may also be referred to simply as a "block".

The first nozzle block for cyan is assigned a mask pattern C1 and the second nozzle block for cyan a mask pattern C2. In a first scan a unit area A of a print medium is printed according to the mask pattern C1 by the first cyan nozzle block. Then, after the print medium is conveyed a distance equal to the width of the unit area A, a second scan is done by the second cyan nozzle block according to the mask pattern C2. With the two printing scans executed, the unit area A is completely printed with a cyan ink according to the sum of the mask patterns C1 and C2. At this time the mask patterns C1 and C2 are in a complementary relationship with each other, which means that all of the cyan binary data is printed in two printing scans by the first nozzle block or the second nozzle block. To divide the binary image data into two pieces for the two nozzle blocks as described above, this embodiment uses the mask patterns as a means to determine whether or not individual pixels are permitted to be printed with the associated image data.

Figure 7:
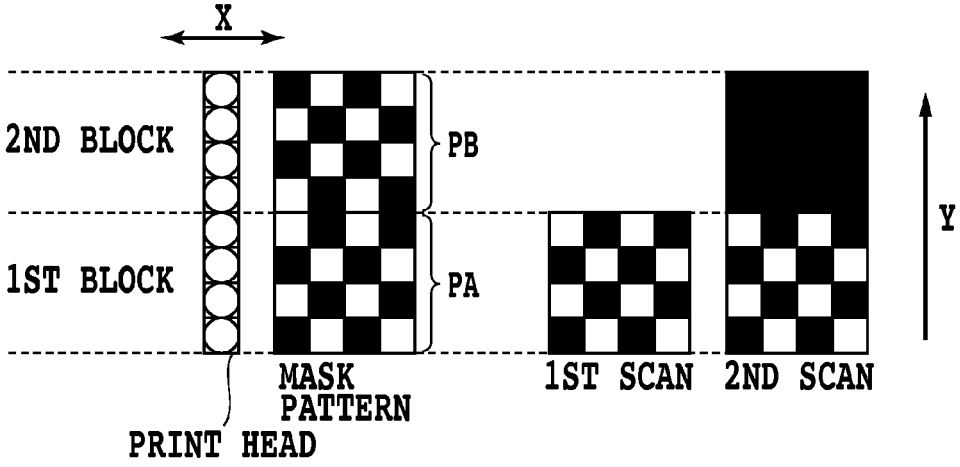
FIG. 7 is a schematic diagram showing an example of a mask pattern used in a 2-pass printing.

FIG. 7 is a schematic diagram showing an example of a detailed mask pattern used in the 2-pass printing. For the sake of simplicity, the print head in this example has a total of eight nozzles, of which four nozzles are allocated to the first nozzle block and the remaining four to the second nozzle block. In this example, the mask pattern for the first nozzle block is denoted PA and the mask pattern for the second nozzle block PB. The mask patterns each have a 4×4-pixel area. Pixels shown in black represent pixels that are permitted to be printed (printable pixels) and blank pixels are pixels not permitted to be printed (unprintable pixels). The mask patterns PA and PB are complementary to each other. That is, with the first scan by the first nozzle block and the second scan by the second nozzle block performed, the printing on all pixels in the unit area of the print medium is completed.

Although, for the sake of simplicity, the mask patterns in this embodiment are formed in a 4×4-pixel size and have the printable pixels and unprintable pixels alternated and staggered, the mask patterns actually used in multipass printing may be set larger in size and the arrangement of the printable pixels and unprintable pixels set more irregular and complex.

Further, although in the above explanation a 2-pass printing has been taken as an example, the invention can deal with multipass printing with three, four or even a greater number of passes. What is required of an N-pass printing in this invention is that the nozzle group be divided into N blocks, that the N blocks be individually assigned mask patterns that are complementary to each other and that, between the printing scans, a print medium be conveyed a distance equal to the width of the nozzle block.

In the following, features of the mask patterns of this invention will be detailed in some example cases using the ink jet printing system and the multipass printing method described above.

Embodiment 1

In this embodiment a mask pattern that can be used for a 4-pass printing will be explained. FIGS. 8-11 show distributions of print permission ratios for a plurality of nozzles for comparison between the mask patterns of this embodiment and the conventional mask patterns. In these figures, an abscissa represents positions of nozzles in the direction of arrayed nozzles (first direction) and an ordinate represents a print permission ratio of individual nozzles. In this embodiment, the "print permission ratio" is defined to be a ratio of pixels that a mask pattern allows to be printed to a total of pixels making up an area over which individual nozzles pass in one scan movement. Therefore, the use of the mask pattern enables individual nozzles to perform the multipass printing according to the predetermined print permission ratio, not according to the image data.

In the case of 4-pass printing, each of the nozzle groups is divided into four nozzle blocks in the first direction and, between each of the four printing scans, a print medium is conveyed a distance equal to the width of one block, completing in four printing scans an image that is intended to be printed in the unit area having a width equal to that of one block. Here, the four nozzle blocks are shown to be a first block to a fourth block. In this embodiment, one nozzle group comprises 1,280 nozzles, so each block is made up of 320 nozzles.

Figure 1A:
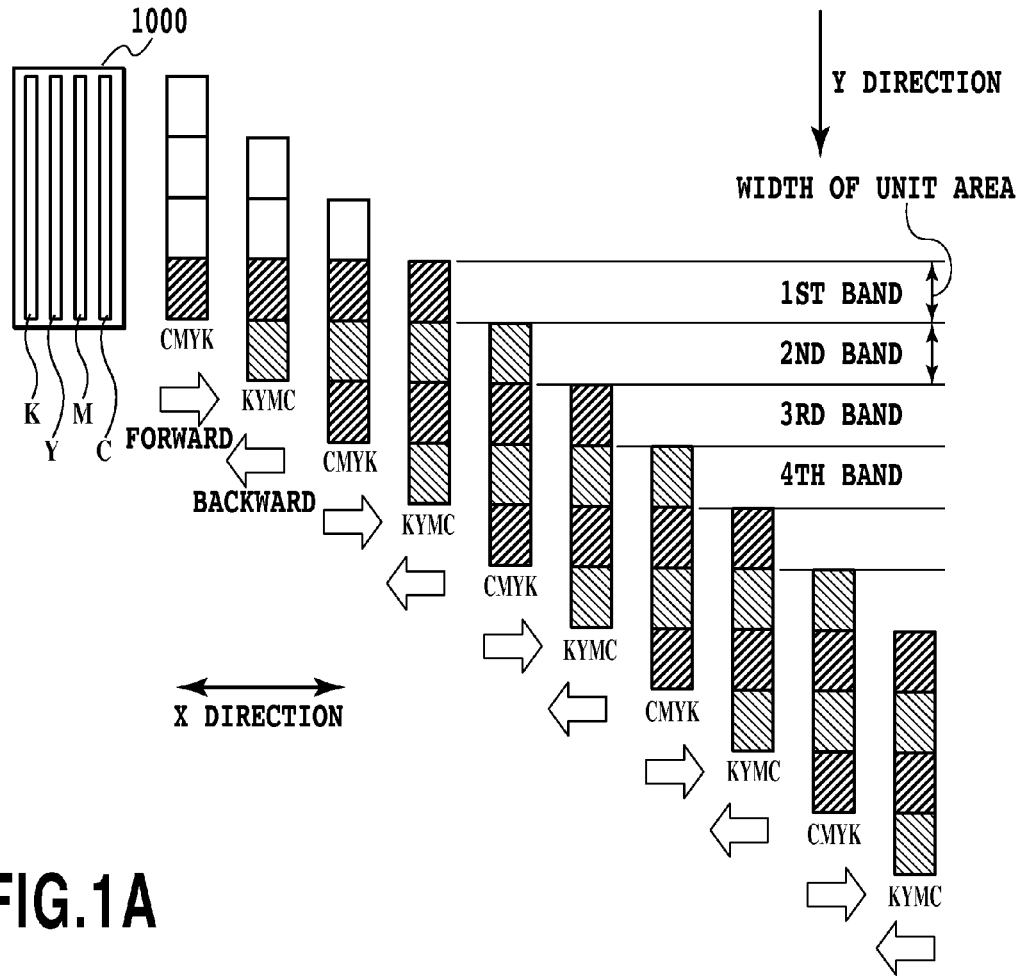
FIGS. 1A and 1B are schematic diagrams explaining a cause and a phenomenon of interband variations in detail.
Figure 1B:
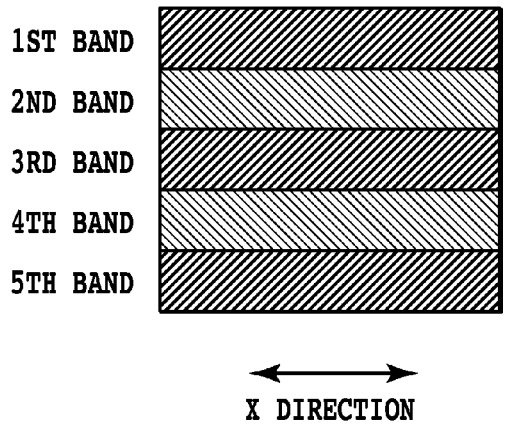
Figure 8:
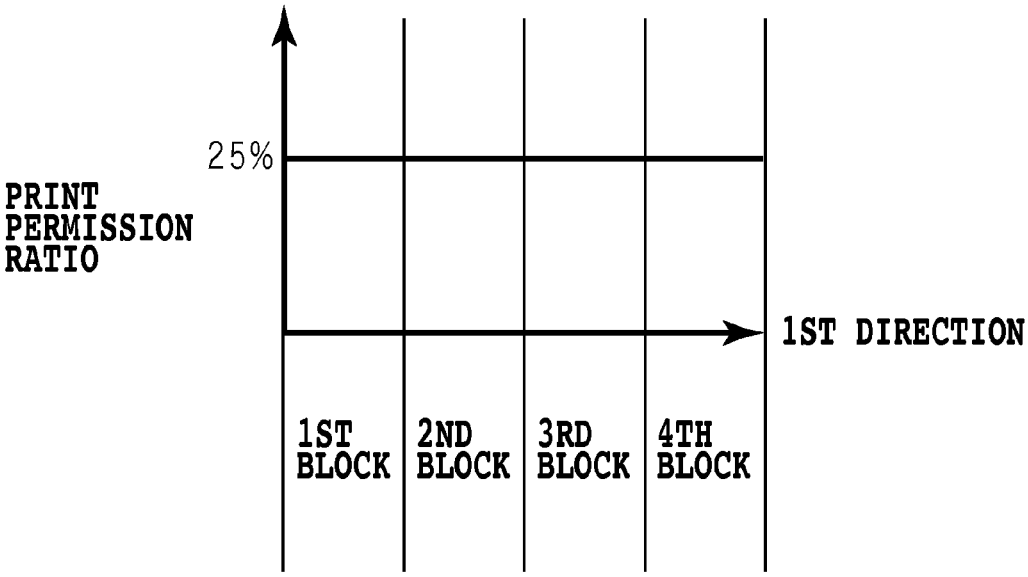
FIG. 8 illustrates an example of a mask pattern having a print ratio of 25% in all nozzle blocks (flat mask)

The unit area 320 nozzles width undergoes a first printing scan by the first block, followed by a second printing scan by the second block, followed by a third printing scan by the third block, followed by a fourth printing scan by the fourth block. The image therefore is completed by the four blocks executing a total of four printing scans. FIG. 8 shows an example mask pattern with a print permission ratio of 25% in all blocks. That is, the unit area (same image area) of the print medium is fully printed (100%=25%+25%+25%+25%) by the four blocks (first to fourth block). In the following, a mask pattern having a fixed print permission ratio throughout all nozzles is called a "flat mask". When a bidirectional multipass printing is performed using such a flat mask, unit areas printed in different orders of color ink application and at different color ink application timings are alternated, forming so-called "interband variations", as already explained with reference to FIG. 1.

Figure 9:
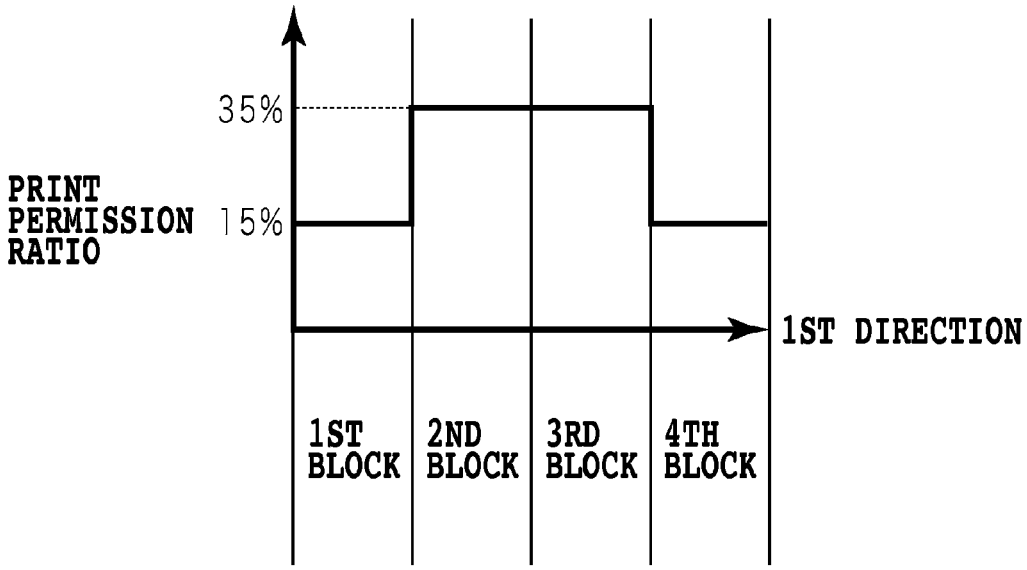
FIG. 9 illustrates an example of a mask pattern having a print ratio adjusted among a plurality of nozzle blocks to prevent "interband variations" from showing (stepwise mask)

FIG. 9 shows an example mask pattern obtained by adjusting the print permission ratios among a plurality of nozzle blocks so as not to prevent the "interband variations" from showing. This mask pattern has a print permission ratio of 15% in the first and fourth block and 35% in the second and third block, so the unit area of the print medium is fully printed (100%=15%+35%+35%+15%) by the four blocks (first to fourth block). In the following, a mask pattern that has its individual print permission ratios substantively fixed within each block but adjusted to differentiate among different blocks is called a "stepwise mask". It is noted, however, that when a bidirectional multipass printing is performed using the stepwise mask, "seam lines" may become visible where the print medium is printed by the boundary portions of the nozzle blocks due to effects of differences in the print permission ratio between adjoining nozzle blocks, as already explained in the Description of the Related Art. Particularly when the difference in the print permission ratio between the adjoining blocks is large, the "seam lines" are likely to be produced.

Figure 10:
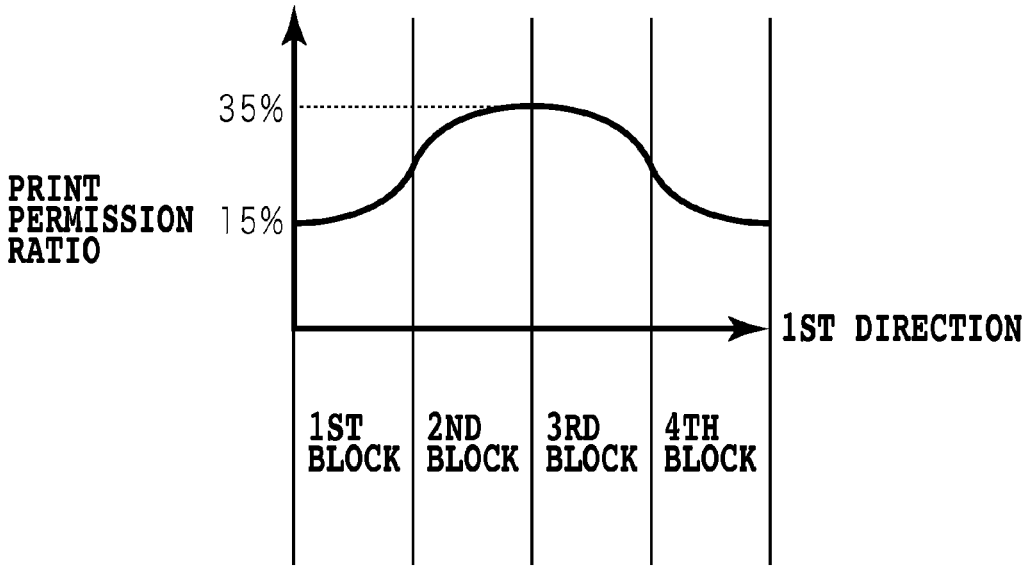
FIG. 10 illustrates an example of mask pattern having a print ratio adjusted among individual nozzles to suppress both "interband variations" and "seam lines" (gradation mask)

FIG. 10 shows a conventional mask pattern that has print permission ratios of individual nozzles adjusted so as to suppress both the "interband variations" and "seam lines". This mask pattern adjusts the print permission ratio among individual nozzle blocks and also adjusts it among individual nozzles so that the print permission ratio does not change sharply at boundaries between adjoining nozzle blocks and throughout the entire nozzle area. In this document, a mask pattern in which the print permission ratio in the entire area changes moderately both within each of the nozzle blocks and between different nozzle blocks is called a "gradation mask". With the gradation mask, it is possible to adjust the print permission ratio appropriately among different nozzle blocks while at the same time moderately changing the print permission ratio at a boundary between adjoining nozzle blocks, which in turn allows for suppressing both the "interband variations" and the "seam lines". It is noted, however, that when the print permission ratio is changed within each nozzle block, as with the gradation mask, new image impairments or "intraband variations", such as density variations, color unevenness or gloss unevenness within the unit area, may occur.

Figure 11:
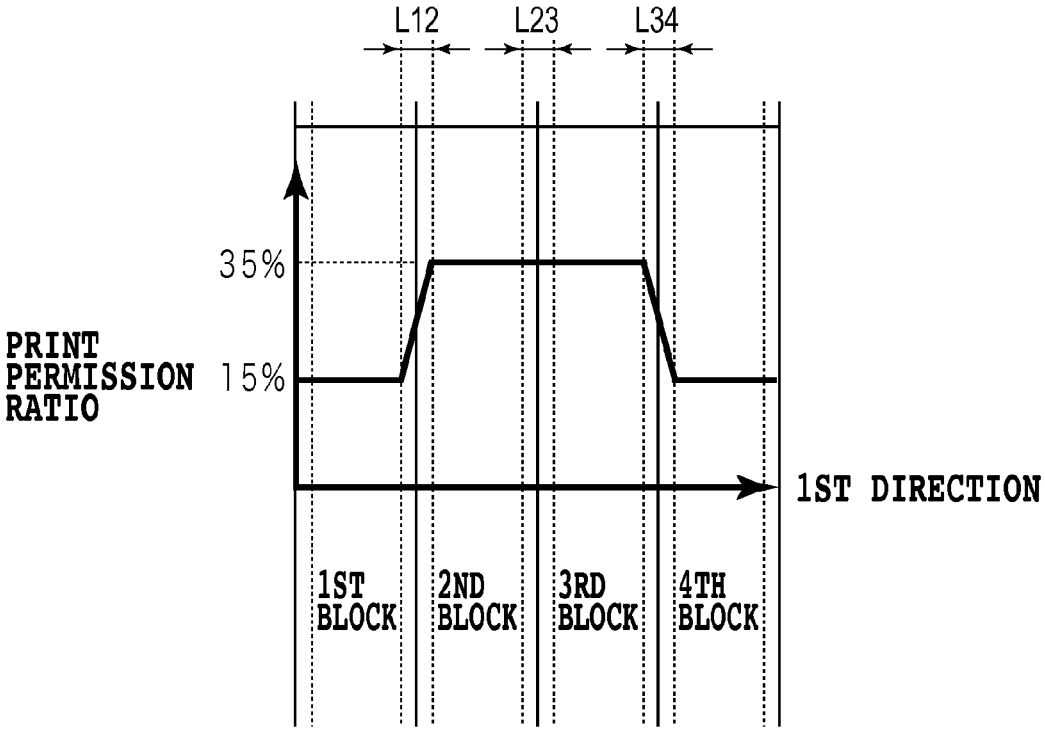
FIG. 11 illustrates an example of a mask pattern made to reduce all of "interband variations", "seam lines" and "intraband variations"

FIG. 11 shows a mask pattern employed in this embodiment that is intended to suppress all the "interband variations", "seam lines" and "intraband variations". The mask pattern of this embodiment is designed to meet all requirements—a first condition to suppress the "interband variations", a second condition to suppress the "seam lines" and a third condition to suppress the "intraband variations". The first condition refers to a condition in which the print permission ratio is adjusted among different nozzle blocks. Because the print permission ratio is adjusted, the print permission ratios of at least two adjoining blocks (e.g., the first block and the second block) differ from each other. The second condition refers to a condition in which the print permission ratio does not change sharply at boundary sections between adjoining nozzle blocks. The third condition refers to a condition in which the print permission ratio is substantively constant within each of the nozzle blocks at non-boundary sections.

The words "substantively constant" rather than "constant" are used because the mask pattern of this embodiment is not required to make the print permission ratio strictly constant among different nozzles. As explained earlier, the mask pattern is a pattern that determines whether a fixed number of pixels making up an area over which the nozzles pass in one scan movement of the print head are each permitted or not permitted to be printed. The print permission ratio of each nozzle depends on how many printable pixels there are among the fixed number of pixels. Therefore, for setting the print permission ratio in a nozzle group evenly, the numbers of printable pixel corresponding to each nozzle in the nozzle group should be set at the same value. However, for the following reasons, it may be impossible or difficult to set the same numbers of printable pixel for all nozzles of the nozzle group exactly. Let's consider a case in which the print permission ratio of a nozzle group made up of 10 nozzles is set to 15%. In this case, if the size of the mask pattern in the scanning direction is 100 pixels, the print permission ratio of each nozzle in the nozzle group can be set to 15% by setting the number of printable pixels corresponding to each nozzle in the nozzle group to 15. On the other hand, if the size of the mask pattern in the scanning direction is 128 pixels, it is desirable that the number of printable pixels corresponding to each nozzle in the nozzle group is set to 19.2 evenly. However, a number of printable pixels can not be set to decimal. In this case, the number of printable pixels corresponding to each of 8 nozzles in the nozzle group can be set to 19 and the number of printable pixels corresponding to each of 2 nozzles in the nozzle group can be set to 20. As described above, even for setting a print permission ratio in a nozzle group evenly, the number of printable pixels corresponding to each nozzle of the nozzle group may be different from each other. Therefore, in this embodiment, even in non-boundary sections (areas other than boundary sections), the print permission ratio of each nozzle is not set at an exact value, such as 15% or 35%, and may be set at a value that includes some variations such as above. That is, the expression "substantively constant" is equivalent to a word "constant" including some variations of the print permission ratio and not including some variations within which "intraband variations" can be visibly recognized.

In this embodiment, to satisfy the above three conditions, a boundary section (boundary nozzle section) made up of a predetermined number of nozzles in the nozzle array direction (i.e., first direction) is provided at a portion of a neighborhood of a boundary of two adjoining nozzle blocks. More specifically, there are provided a boundary section L12 of a first block and a second block, a boundary section L23 of a second block and a third block, and a boundary section L34 of a third block and a fourth block. Each of these boundary sections has 64 nozzles. Those nozzles making up the boundary sections are called boundary nozzles. The boundary section L12 has a total of 64 nozzles, of which 32 nozzles are in the first block and the remaining 32 nozzles in the second block. Similarly, the boundary section L23 has a total of 64 nozzles, of which 32 nozzles are in the second block and the remaining 32 nozzles in the third block. The boundary section L34 has a total of 64 nozzles, of which 32 nozzles are in the third block and the remaining 32 nozzles in the fourth block. In each of the nozzle blocks that portion of nozzles not included in the boundary sections is defined to be a non-boundary section. Nozzles making up the non-boundary section are called non-boundary nozzles. As described above, one nozzle block has 320 nozzles, of which 32 are boundary nozzles on one side, so that there are 288 or 256 non-boundary nozzles. At the boundary sections (L12, L34) of the mask pattern, the print permission ratio of the boundary section is changed continuously or stepwise with a fixed inclination so that it will change moderately between different print permission ratios of two non-boundary sections situated on both sides of the boundary section. That is, rather than having the nozzles with a print permission ratio of 15% and the nozzles with a print permission ratio of 35% directly adjoin each other at the boundary between the first block and the second block, as shown in the stepwise mask of FIG. 9, the print permission ratio is changed progressively from 15% to 35% over the range of 64 nozzles in the boundary section L12. That is, the print permission ratio of the boundary nozzles between the first block and the second block changes stepwise or continuously between the print permission ratio of the non-boundary nozzles of the first block (first value of 15%) and the print permission ratio of the non-boundary nozzles of the second block (second value of 35%). Provision of these boundary sections L12, L23 and L34 in the mask pattern of this embodiment allows for satisfying the second condition that the print permission ratio must not change sharply at the boundary between adjoining nozzle blocks. In this embodiment, it is noted that the numbers of boundary nozzles and non-boundary nozzles are not limited to those described above although the number of boundary nozzles needs to be less than that of non-boundary nozzles.

Further, unlike the gradation mask of FIG. 10, the mask pattern of this embodiment is characterized in that the print permission ratio does not change within each nozzle block. In the non-boundary sections, the print permission ratios of the first and fourth block are substantively constant at 15% and the print permission ratios of the second and third block are substantively constant at 35%. That is, the mask pattern of this embodiment meets the third condition that the print permission ratio of the non-boundary section in each nozzle block must be substantively constant.

Further, the mask pattern of this embodiment is characterized in that, unlike the conventional flat mask of FIG. 8, the print permission ratio is not constant throughout the entire nozzle range but is adjusted properly among individual nozzle blocks. More specifically, the print permission ratios in non-boundary sections of at least two adjoining blocks (e.g., first block and second block) differ. That is, the mask pattern of this embodiment meets the first condition that the print permission ratio is so adjusted among a plurality of nozzle blocks and that the print permission ratios in the non-boundary sections of at least two adjoining blocks differ.

It is therefore possible to produce an image with no "interband variations", "seam lines" or "intraband variations" by the use of such a mask pattern as shown in FIG. 11 that can meet all of the first to third condition.

FIG. 12 shows a result of comparison of image quality when 4-pass printings are performed using the mask patterns of FIGS. 8-11 in the ink jet printing system of FIGS. 2-5. In this examination matte paper with no gloss is used as a print medium. The comparison table shows that none of the conventional masks cannot eliminate all of the "interband variations", "intraband variations" and "seam lines" at once. The use of the mask pattern of this invention, however, can suppress all of the image impairment phenomena simultaneously, producing good images.

The inventors of this invention have found in this examination that the similar evaluation result can be obtained when the print medium is changed to glossy paper. It is noted, however, that when the kind of print medium is changed, the "interband variations" may differ in terms of how they appear and their intensity. For example, with matte paper, the same color may look different among bands; and with glossy paper a glossiness difference also shows up in addition to the color difference. The matte paper and the glossy paper may also have different degrees of color variation. Under this circumstance, this embodiment, while satisfying the above three conditions, can provide a plurality of print modes each with a different mask pattern that uses a different print permission ratio in the non-boundary section of the same block. For example, for matte paper the print permission ratios in the first and fourth block may be set at 15% and those in the second and third block at 35%; and for glossy paper they may be set at 20% and 30%, respectively. Provision of a plurality of print modes that set the print permission ratios of individual nozzle blocks to appropriate values according to various conditions such as a kind of print medium, as described above, allows the user to choose an appropriate print mode when the printing condition has changed.

There are print media that may or may not relatively easily show "seam lines". With a print medium that does not show "seam lines" relatively easily, increasing the number of nozzles in the boundary section to more than necessary may result in "intraband variations", another image impairment, showing up undesirably. There are other media that may not show "intraband variations" relatively easily but noticeably show "seam lines". It is therefore preferred to adjust, as circumstance demands, the number of nozzles making up the boundary section in a way that makes both the "seam lines" and "intraband variations" as unnoticeable as possible. That is, in this embodiment, a plurality of mask patterns can be prepared which have different boundary section widths (different numbers of nozzles making up the boundary section).

FIG. 13 shows a result of examination into the states of "intraband variations" and "seam lines" when a 4-pass printing is performed on matte paper using a mask pattern of this embodiment by changing the width of boundary sections to three different settings. In the figure, let us look at a boundary section width of 16 nozzles and the examination result table shows that "intraband variations" are not noticeable whereas "seam lines" show. When the boundary section width is expanded to 256 nozzles, it is found that "seam lines" are not easily noticeable but "intraband variations" are. When the boundary section width is set to 64 nozzles as explained in FIG. 11, neither the "intraband variations" nor "seam lines" are noticeable. That is, when a 4-pass bidirectional printing is performed on matte paper, good images can be produced by using a mask pattern with a boundary section width of 64 nozzles (about 1.35 mm), such as shown in FIG. 11. It is noted that a balance between "intraband variations" and "seam lines" in terms of how visibly they show up may change depending on a print resolution, an ink ejection volume and a kind of print medium. In such circumstances, provision of a plurality of print modes each with a different mask pattern that sets the boundary section width to an appropriate value according to various conditions, such as print medium kind, allows for the user to choose an appropriate print mode if the print condition has changed.

How visible image impairments are depends on a distance that a person observes a printed image. For example, the distance at which we look at a printed matter of a post card size often differs from the distance that we look at a large printed matter such as a poster. Therefore a plurality of mask patterns may be provided even for multipass printing operations with the same resolution, the same print medium and the same number of passes so that the print permission ratio of individual nozzle blocks and the boundary section width can be changed according to the size of the print medium.

As described above, when performing a printing operation according to a print permission ratio predetermined for each nozzle in a plurality of blocks, this embodiment makes arrangements to satisfy the following requirements (i) and (ii) with at least adjoining first and second block. With this arrangement, the condition 1 to 3 can be met, allowing for reducing "interband variations", "intraband variations" and "seam lines" at the same time.

(i) The print permission ratios of non-boundary nozzles of the first and second nozzle block are each substantively constant and differ from each other.

(ii) The print permission ratios of boundary nozzles of the first and second nozzle block change stepwise or continuously between a print permission ratio of non-boundary nozzles of the first nozzle block and a print permission ratio of non-boundary nozzles of the second nozzle block.

Embodiment 2

Figure 14:
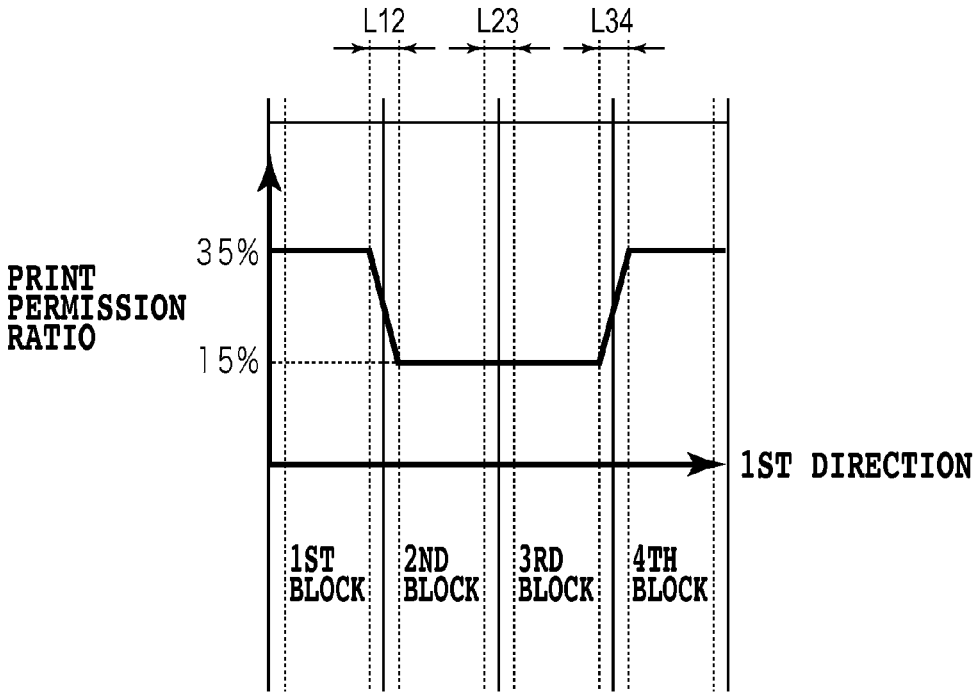
FIG. 14 shows a distribution of print permission ratios in a mask pattern used in embodiment 2.

FIG. 14 shows a distribution of print permission ratios in a mask pattern used in embodiment 2. As explained above, the "interband variations" may change in terms of how they appear and their intensity depending on the kind of print medium used and other printing conditions. Similarly, the print permission ratios of individual nozzle blocks adjusted to reduce the "interband variations" and the distribution of these print permission ratios also may change depending on the printing conditions. As shown in FIG. 14, the mask pattern of this embodiment has the distribution of the print permission ratios inverted from that of FIG. 11. This mask pattern also can satisfy the above conditions 1 to 3. So, with this mask pattern a high quality image can be produced according to the kind of print medium used and other printing conditions.

Embodiment 3

Figure 15:
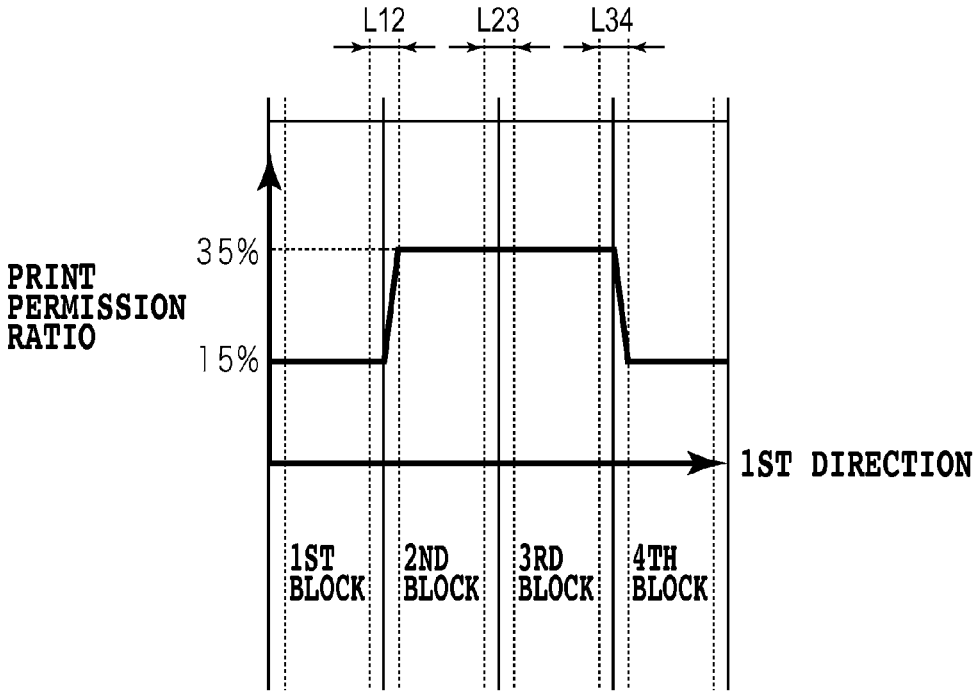
FIG. 15 shows a distribution of print permission ratios in a mask pattern used in embodiment 3.

FIG. 15 shows a distribution of print permission ratios in a mask pattern used in embodiment 3. In the preceding two embodiments, the distribution of print permission ratio is laterally symmetrical with respect to a center of the nozzle arraying direction, i.e., the boundary between the second block and the third block. That is, in the preceding two embodiments, the distribution of print permission ratio is laterally symmetrical about an axis which is perpendicular to an axis along the nozzle arraying direction. On the contrary, this embodiment adopts a laterally non-symmetrical mask pattern.

In this embodiment too, the print permission ratios of the first to fourth block and the width of boundary sections (the number of nozzles in each boundary section) are similar to those of embodiment 1. It is noted, however, that this embodiment has the distribution of print permission ratios in the boundary sections L12 and L34 differ from that of embodiment 1.

The mask pattern of FIG. 15 used in embodiment 3 will be compared in detail with that of FIG. 11 used in embodiment 1. In the boundary section L12 of FIG. 11 of embodiment 1 there are a total of 64 nozzles, of which 32 nozzles are in the first block and the remaining 32 nozzles in the second block. Using the contiguously arranged 64 nozzles, the print permission ratio in the boundary section L12 is progressively changed with a fixed inclination in order to connect the first block print permission ratio to the second block print permission ratio. On the contrary, this embodiment makes the following arrangement in the boundary section L12. The print permission ratio of the 32 nozzles in the first block is set at 15%, the same ratio as the remaining nozzles in the first block, while the print permission ratio of the 32 nozzles in the second block is changed from 15% to 35% with a fixed inclination. That is, the print permission ratio in the boundary section L12 between the first and second block is set to be equal to or higher than the print permission ratio of the non-boundary section of the first block (15%) and lower than the print permission ratio of the non-boundary section of the second block (35%). As for the boundary section L34, the print permission ratio of the 32 nozzles in the third block is set at 35%, the same ratio as the remaining nozzles in the third block, while the print permission ratio of the 32 nozzles in the fourth block is changed progressively from 35% to 15% with a fixed inclination. That is, the print permission ratio of the boundary section L34 between the third and fourth block is set to be equal to or lower than the print permission ratio of the non-boundary section of the third block (35%) and higher than the print permission ratio of the non-boundary section of the fourth block (15%).

In this distribution of print permission ratio, the width of boundary section becomes narrow compared with that of embodiment 1, resulting in a corresponding increase in the inclination of the print permission ratio in the boundary section. This mask pattern can also satisfy the first to third condition described above and thus can produce high quality images according to the kind of print medium used and other printing conditions.

Embodiment 4

Figure 16:
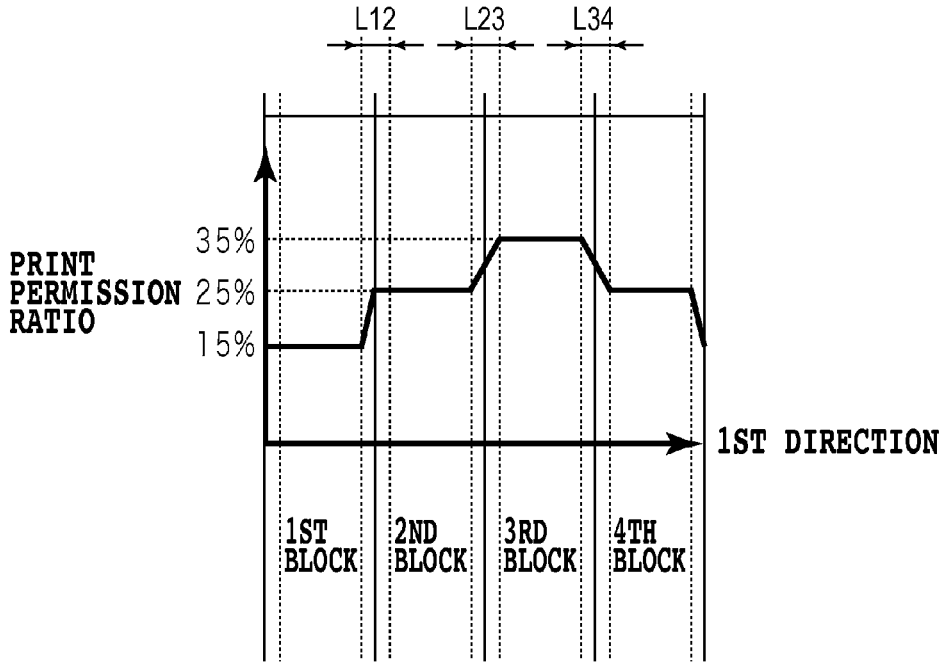
FIG. 16 shows a distribution of print permission ratios in a mask pattern used in embodiment 4.

FIG. 16 shows a distribution of print permission ratios in a mask pattern used in embodiment 4. This embodiment also uses a laterally non-symmetrical mask pattern.

In the non-boundary sections of the mask pattern of FIG. 16, the first block print permission ratio is set at 15%, the second block print permission ratio at 25%, the third block print permission ratio at 35% and the fourth block print permission ratio at 25%. As for the boundary sections L12, L23, L34, the print permission ratios change between the different print permission ratios of the non-boundary sections of the adjoining blocks on both sides. That is, in the boundary section L12, the 32 nozzles included in the first block change their print permission ratios smoothly between 15% and 25% with a fixed inclination. The 64 nozzles included in the boundary section L23 smoothly change their print permission ratios between 25% and 35% with a fixed inclination. In the boundary section L34 the 64 nozzles change their print permission ratios between 35% and 25% smoothly with a fixed inclination. Further, the 32 nozzles situated at the end of the fourth block smoothly change their print permission ratios between 25% and 15% with a fixed inclination.

When a 4-pass printing is performed using a mask pattern with such a distribution of print permission ratio, a 100% image can be printed in the unit area of print medium by four printing scans of the four nozzle blocks. In addition, the above first to third conditions are also satisfied. The mask pattern of this embodiment therefore allows for producing high quality images according to the kind of print medium used and other printing conditions.

Embodiment 5

Figure 17:
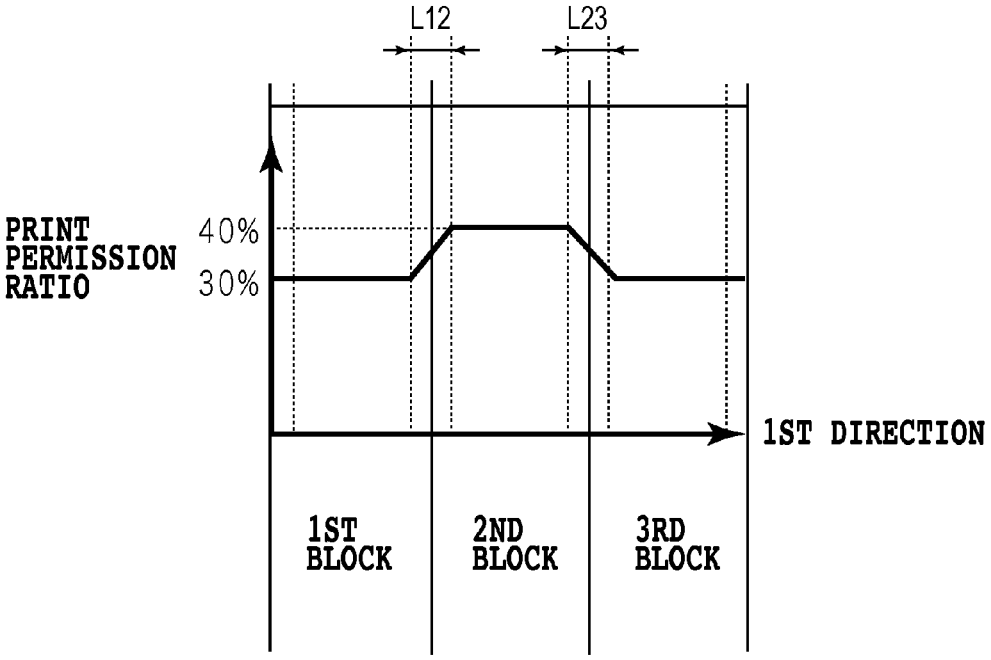
FIG. 17 shows a distribution of print permission ratios in a mask pattern used in embodiment 5.

FIG. 17 shows a distribution of print permission ratios in a mask pattern used in embodiment 5. While in embodiment 1-4 mask patterns for the 4-pass printing have been explained, this embodiment will explain a mask pattern for a 3-pass printing.

In a 3-pass printing, each of the nozzle groups is divided into three nozzle blocks in the nozzle array direction (first direction) and the unit area of a print medium is printed by three printing scans of the three nozzle blocks to form a 100% image. Each nozzle group comprises 1,280 nozzles. Since 1,280 cannot be divided by 3, three nozzle blocks are each assigned 424 nozzles, the number close to 1,280 divided by 3. So, the width of the unit area printed by three passes is 424 nozzles width, equivalent to the width of one nozzle block. As described above, of the 1,280 nozzles making up one nozzle group, 1,272 nozzles (=424×3) are made available for printing and divided into three nozzle blocks each composed of 424 nozzles.

In this embodiment, the non-boundary sections in the first block and the third block are set to a print permission ratio of 30% and the non-boundary section in the second block to 40%. A plurality of nozzles included in the boundary sections L12 and L23 change their print permission ratios smoothly between 30% and 40%, the print permission ratios of the non-boundary sections, with a fixed inclination.

The 3-pass printing using the mask pattern with the above print permission ratio distribution is found to meet the first to third condition described above. The mask pattern of this embodiment therefore allows for producing high quality images according to the kind of print medium used and other printing conditions.

Embodiment 6

Figure 18:
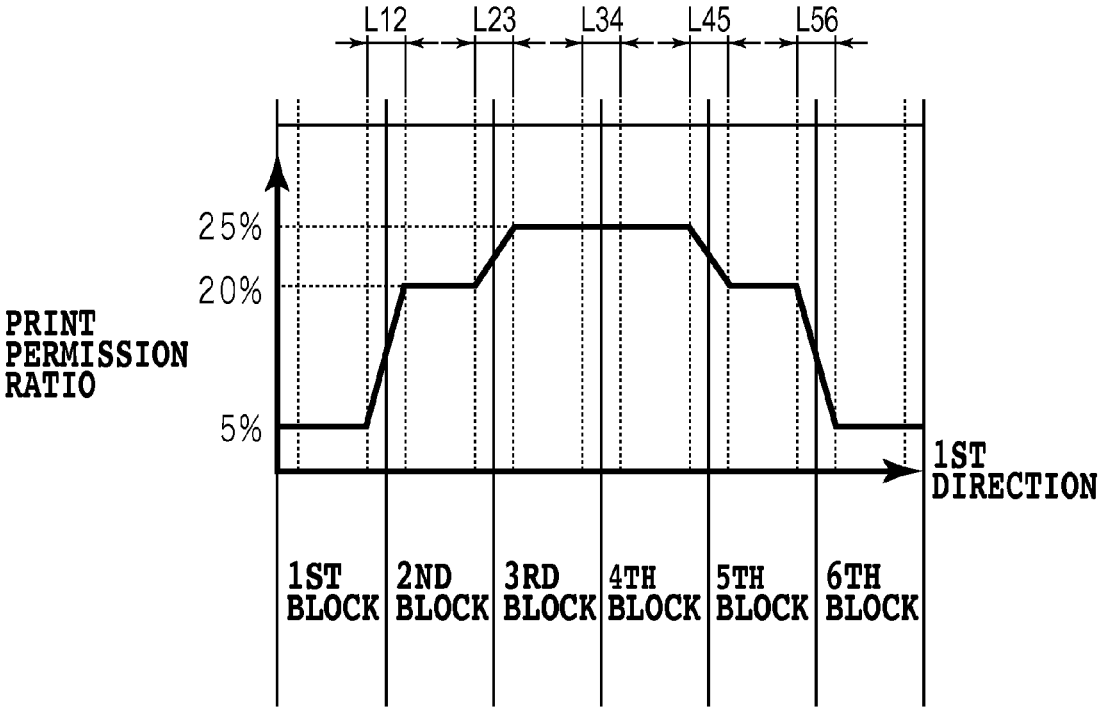
FIG. 18 shows a distribution of print permission ratios in a mask pattern used in embodiment 6.

FIG. 18 shows a distribution of print permission ratios in a mask pattern used in embodiment 6. This embodiment explains a mask pattern that may be used in executing a 6-pass printing.

In a 6-pass printing, each of color nozzle groups is divided into six nozzle blocks in the nozzle array direction (first direction) and the unit area of a print medium is printed by six printing scans of the six nozzle blocks to form a 100% image. Each nozzle group comprises 1,280 nozzles. Since 1,280 cannot be divided by 6, six nozzle blocks are each assigned 212 nozzles, the number close to 1,280 divided by 6. So, the width of the unit area printed by six passes is 212 nozzles width, equivalent to the width of one nozzle block. As described above, of the 1,280 nozzles making up one nozzle group, 1,272 nozzles (=212×6) are made available for printing and divided into six nozzle blocks each composed of 212 nozzles.

In this embodiment, the non-boundary sections in the first block and the sixth block are set to a print permission ratio of 5% and the non-boundary sections in the second and the fifth block to 20% and the non-boundary sections in the third and the fourth block to 25%. A plurality of nozzles included in the boundary sections L12 and L56 change their print permission ratios smoothly between 5% and 20% with a fixed inclination. And a plurality of nozzles included in the boundary sections L23 and L45 change their print permission ratios smoothly between 20% and 25% with a fixed inclination.

The 6-pass printing using the mask pattern with the above print permission ratio distribution is found to meet the first to third condition described above. The mask pattern of this embodiment therefore allows for producing high quality images according to the kind of print medium used and other printing conditions.

Embodiment 7

Figure 19:
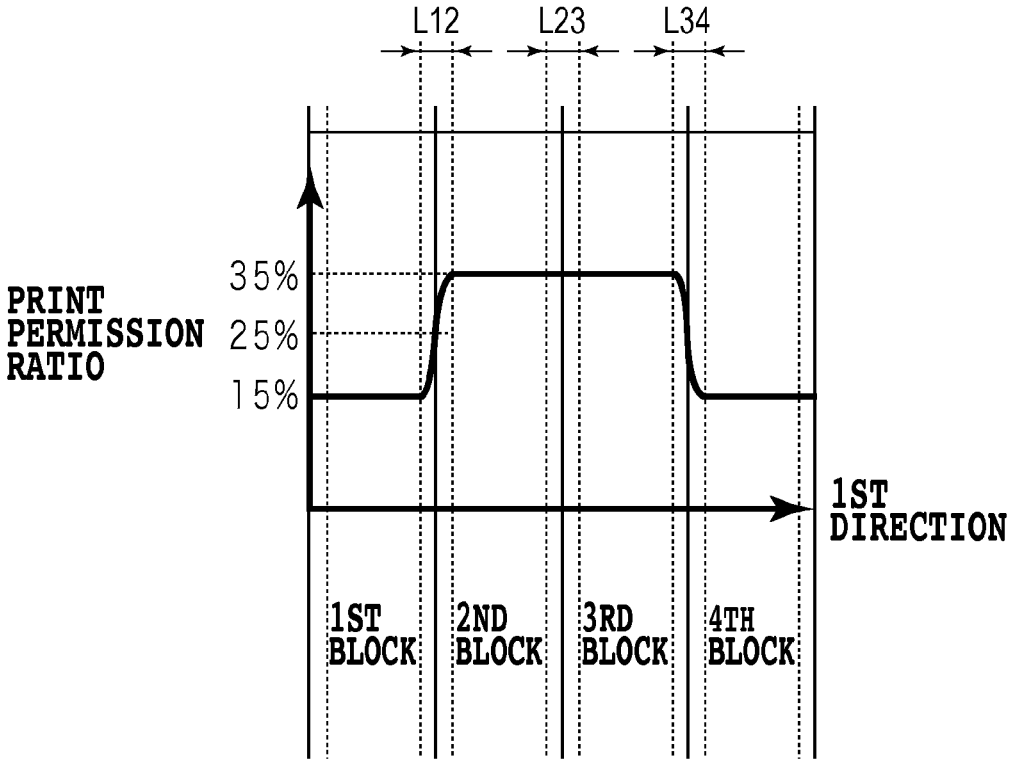
FIG. 19 shows a distribution of print permission ratios in a mask pattern used in embodiment 7.

FIG. 19 shows a distribution of print permission ratios in a mask pattern used in embodiment 7. Like FIG. 11 of embodiment 1, FIG. 19 also shows a mask pattern for a 4-pass printing, with the print permission ratios of the first to fourth block and the width of the boundary sections set equal to those of embodiment 1. In this embodiment, however, the geometry of print permission ratio distribution in the boundary sections L12 and L34 differs from that of embodiment 1.

In embodiment 1, the 64 nozzles included in the boundary sections L12 and L34 change their print permission ratios between 15% and 35% with a fixed inclination, i.e., by using a linear function. To satisfy the second condition required of the mask pattern of this invention, a change in the print permission ratio in this area does not have to be a linear function. What is required is that the print permission ratio in the boundary between the adjoining nozzle blocks does not change sharply. So, in this embodiment, the print permission ratio is changed in a smooth curve between 15% of the first block and 35% of the second block. Such a curve can be set by using, for example, an n-th degree function and a trigonometric function with an inflection point in the boundary section. Continuity of the print permission ratio can be made more smooth with these functions than with a linear function.

The 4-pass printing using the mask pattern with the above print permission ratio distribution is found to meet the first to third condition described above. The mask pattern of this embodiment therefore allows for producing high quality images according to the kind of print medium used and other printing conditions.

Other Embodiments

In the above embodiments, a multipass printing is realized which can be performed according to the print permission ratios, that are predetermined for individual nozzles irrespective of image data, by using a mask pattern that predetermines whether or not a dot is permitted to be printed in each of pixels located within an area over which the individual nozzles pass for printing. In that case, however, since the image data is distributed to individual nozzles of a plurality of blocks through a logical AND between the image data and the mask pattern, the distribution of the distributed image data does not necessarily perfectly match the distributions of the print permission ratios shown in FIGS. 11-19. However, the use of the mask pattern generally causes the "print permission ratios of individual nozzles" determined by the mask pattern to substantively match the "ratio of those pixels that the nozzles actually prints on to pixels that are determined to be printed" through the logical AND of the image data and the mask pattern. This means that determining the print permission ratios of individual nozzles is almost equivalent to determining the actual printing ratio of individual nozzles.

While the above embodiments have shown example cases for realizing the print permission ratios that satisfy the above first to third conditions, it is necessary to meet the following two requirements (i) and (ii) in satisfying the above first to three conditions.

(i) A plurality of nozzle blocks include a first block with a substantially constant print permission ratio and a second block adjoining the first block and with a print permission ratio different from that of the first block.

(ii) The print permission ratio in the boundary section between the first block and the second block changes stepwise or continuously between the print permission ratios of the first block and the second block.

(iii) In each of the nozzle blocks, the print permission ratio in the non-boundary section excluding the boundary section in contact with the adjoining nozzle block is preferably substantively constant.

In the above embodiments, a color ink jet printing apparatus has been described which performs printing by moving a print head having nozzle groups for four colors in an X direction. This invention, however, is not limited to this configuration. The print head may have more than four nozzle groups to eject a greater number of color inks or may have only one nozzle group for ejecting only a black ink, for instance. In the case of black ink only, the "interband variations" caused by the color ink application order does not occur but the "interband variations" caused by ink application timing differences among a plurality of printing scans still persist. In this situation, the present invention can be effectively applied to produce its intended result.

Further, in the above embodiments, a series of image processing steps has been shown to be shared by the host device 100 and the printing apparatus 104, as shown in FIG. 5. This invention is not limited to this configuration. For example, the image data in the form of multivalued data as processed by the γ-correction J0004 may be transferred to the printing apparatus 104 where it is subjected to the binarization operation and the mask operation. It is also possible to perform the process up to the mask processing J0008 by the host device or to perform the entire process following the pre-processing J0002 by the printing apparatus. Whichever is adopted, the only requirement for the printing apparatus or printing system to fall within the range of this invention is that the binarized print data is distributed to a plurality of nozzles according to the predetermined print permission ratios and printed in a multipass printing mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-205908, filed Aug. 8, 2008 which is hereby incorporated by reference herein in its entirety.

What is claimed is:

1. An ink jet printing apparatus for printing an image on a print medium by ejecting ink from a print head in which a plurality of nozzles are arrayed in a predetermined direction so as to form a nozzle array comprising:

a conveying unit configured to convey the print medium relative to the print head a distance corresponding to a width of one of a plurality of nozzle blocks that are formed by dividing the nozzle array in the predetermined direction, and a printing unit configured to form an image in a region corresponding to one of the nozzle blocks on the print medium by a plurality of movements of the print head, each of the movements being performed according to a print permission ratio predetermined for individual nozzles in the plurality of nozzle blocks, the print permission ratio being a ratio of the number of those pixels that are permitted to be printed by each nozzle in one movement of the print head to a total number of pixels making up an area over which the nozzle passes in one movement of the print head, wherein the print permission ratios are set such that the print permission ratios corresponding to nozzles in a non-boundary section of the first nozzle block is a substantively constant first ratio, the print permission ratios corresponding to nozzles in a non-boundary section of the second nozzle block adjoining to the first nozzle block is a substantively constant second ratio that is larger than the first ratio, and the print permission ratios corresponding to nozzles in a boundary section of the first nozzle block and the second nozzle block increase progressively from the first ratio to the second ratio according to a location of nozzle in the predetermined direction from a side of the first nozzle block to a side of the second nozzle block.

2. The ink jet printing apparatus according to claim 1, wherein the print permission ratios corresponding to nozzles in the non-boundary section of each of the plurality of nozzle blocks are substantively constant.

3. The ink jet printing apparatus according to claim 1, wherein a width of a boundary section of each of the nozzle blocks is shorter than a length of a non-boundary section in the predetermined direction.

4. The ink jet printing apparatus according to claim 1, wherein the print permission ratios are set such that a difference between the first ratio and the second ratio is much larger than a variation of the first ratio and a variation of the second ratio.

5. The ink jet printing apparatus according to claim 1, wherein the print permission ratios are set such that the print permitting ratios corresponding to nozzles in the non-boundary sections of edge nozzle blocks located at both edges of the print head in the predetermined direction are smaller than print permitting ratios corresponding to nozzles in the non-boundary section of other than the edge nozzle blocks.

6. The ink jet printing apparatus according to claim 1, wherein the print permission ratios are set such that the print permitting ratios corresponding to nozzles in the boundary section of the first nozzle block and the second nozzle block continuously increase from the first ratio to the second ratio.

7. The ink jet printing apparatus according to claim 1, wherein the print permission ratios are set such that the print permitting ratios corresponding to nozzles in the boundary section of the first nozzle block and the second nozzle block monotonically increase from the first ratio to the second ratio.

8. An ink jet printing method for printing an image on a print medium by ejecting ink from a print head in which a plurality of nozzles are arrayed in a predetermined direction so as to form a nozzle array comprising the steps of:

conveying the print medium relative to the print head a distance corresponding to a width of one of a plurality of nozzle blocks that are formed by dividing the nozzle array in the predetermined direction, and forming an image in a region corresponding to one of the nozzle blocks on the print medium by a plurality of movements of the print head, each of the movements being performed according to a print permission ratio predetermined for individual nozzles in the plurality of nozzle blocks, the print permission ratio being a ratio of the number of those pixels that are permitted to be printed by each nozzle in one movement of the print head to a total number of pixels making up an area over which the nozzle passes in one movement of the print head, wherein the print permission ratio is set such that the print permission ratios corresponding to nozzles in a non-boundary section of the first nozzle block is a substantively constant first ratio, the print permission ratios corresponding to nozzles in a non-boundary section of the second nozzle block adjoining to the first nozzle block is a substantively constant second ratio larger than the first ratio, and the print permission ratios corresponding to nozzles in a boundary section of the first nozzle block and the second nozzle block increase progressively from the first ratio to the second ratio according to a location of nozzle in the predetermined direction from a side of the first nozzle block to a side of the second nozzle block.

9. The ink jet printing method according to claim 8, wherein the print permission ratios corresponding to nozzles in the non-boundary section of each of the plurality of nozzle blocks are substantively constant.

10. The ink jet printing method according to claim 8, wherein a width of a boundary section of each of the nozzle blocks is shorter than a length of a non-boundary section in the predetermined direction.

11. The ink jet printing method according to claim 8, wherein the print permission ratios are set such that a difference between the first ratio and the second ratio is much larger than a variation of the first ratio and a variation of the second ratio.

12. The ink jet printing method according to claim 8, wherein the print permission ratios are set such that the print permitting ratios corresponding to nozzles in the non-boundary sections of edge nozzle blocks located at both edges of the print head in the predetermined direction are smaller than print permitting ratios corresponding to nozzles in the non-boundary section of other than the edge nozzle blocks.

13. The ink jet printing method according to claim 8, wherein the print permission ratios are set such that the print permitting ratios corresponding to nozzles in the boundary section of the first nozzle block and the second nozzle block continuously increase from the first ratio to the second ratio.

14. The ink jet printing method according to claim 8, wherein the print permission ratios are set such that the print permitting ratios corresponding to nozzles in the boundary section of the first nozzle block and the second nozzle block monotonically increase from the first ratio to the second ratio.

15. A data processing apparatus for processing data for printing an image on a print medium by ejecting ink from a print head in which a plurality of nozzles are arrayed in a predetermined direction so as to form a nozzle array, and by conveying the print medium relative to the print head a distance corresponding to a width of one of a plurality of nozzle blocks that are formed by dividing the nozzle array in the predetermined direction, the data processing apparatus comprising:

a control unit configured to cause the print head to print an image in a region corresponding to one of the nozzle blocks on the print medium by a plurality of movements of the print head, each of the movements being performed according to a print permission ratio predetermined for individual nozzles in the plurality of nozzle blocks, the print permission ratio being a ratio of the number of those pixels that are permitted to be printed by each nozzle in one movement of the print head to a total number of pixels making up an area over which the nozzle passes in one movement of the print head; and a setting unit configured to set the print permission ratio such that the print permission ratios corresponding to nozzles in a non-boundary section of the first nozzle block is a substantively constant first ratio, the print permission ratios corresponding to nozzles in a non-boundary section of the second nozzle block adjoining to the first nozzle block is a substantively constant second ratio larger than the first ratio, and the print permission ratios corresponding to nozzles in a boundary section of the first nozzle block and the second nozzle block increase progressively from the first ratio to the second ratio according to a location of nozzle in the predetermined direction from a side of the first nozzle block to a side of the second nozzle block.

16. The data processing apparatus according to claim 15, wherein the print permission ratios corresponding to nozzles in the non-boundary section of each of the plurality of nozzle blocks are substantively constant.

17. The data processing apparatus according to claim 15, wherein a width of a boundary section of each of the nozzle blocks is shorter than a length of a non-boundary section in the predetermined direction.

18. The data processing apparatus according to claim 15, wherein the print permission ratios are set such that a difference between the first ratio and the second ratio is much larger than a variation of the first ratio and a variation of the second ratio.

19. The data processing apparatus according to claim 15, wherein the print permission ratios are set such that the print permitting ratios corresponding to nozzles in the non-boundary sections of edge nozzle blocks located at both edges of the print head in the predetermined direction are smaller than print permitting ratios corresponding to nozzles in the non-boundary section of other than the edge nozzle blocks.

20. The data processing apparatus according to claim 15, wherein the print permission ratios are set such that the print permitting ratios corresponding to nozzles in the boundary section of the first nozzle block and the second nozzle block continuously increase from the first ratio to the second ratio.

* * * * *